US005125493A

United States Patent [19]

Abe

[11] Patent Number: 5,125,493

[45] Date of Patent: Jun. 30, 1992

[54] OUTLET DEVICE FOR COIN PAYOUT HOPPERS

[75] Inventor: Hiroshi Abe, Tokyo, Japan

[73] Assignee: Asahi Seiko Kabushiki Kaisha, Tokyo, Japan

[21] Appl. No.: 605,934

[22] Filed: Oct. 30, 1990

[30] Foreign Application Priority Data

Nov. 2, 1989 [JP] Japan ..... 1-127898[U]

[51] Int. Cl.[5] ..... G07F 1/04

[52] U.S. Cl. ..... 194/344; 453/57

[58] Field of Search ..... 453/32, 49, 50, 51, 453/52, 57; 221/267; 194/334, 338, 344; 193/25 R, 25 A, 25 S, 25 FT, 25 C, DIG. 1

[56] References Cited

U.S. PATENT DOCUMENTS 3,107,767 10/1963 Medoff et al. ..... 193/25 FT
3,396,737 8/1968 Picollo ..... 453/57 X
4,518,001 5/1985 Branham ..... 221/267 X
4,589,433 5/1986 Abe ..... 453/57
4,943,258 7/1990 Abe ..... 453/50 X

*Primary Examiner*—F. J. Bartuska
*Attorney, Agent, or Firm*—Nilles & Nilles

[57] ABSTRACT

The outlet device is used for guiding a coin discharged from a coin payout hopper through an escalator upwardly. The outlet device comprises an outlet chute having a curved coin guiding passage for upwardly guiding coins pushed in a lower inlet in the horizontal direction towards an upper outlet in the vertical direction. The outlet chute is composed of a back plate, a pair of outside and inside edge plates, and an elastically deformable inside front plate of elastomer material such as rubber covering only the inside edge plate positioned in the inner side in relation to a center of curvature of the curved coin guiding passage, the elastically deformable inside front plate having an extension protruding beyond the inner coin guiding edge face of the inside edge plate.

5 Claims, 3 Drawing Sheets

OUTLET DEVICE FOR COIN PAYOUT HOPPERS

BACKGROUND OF THE INVENTION

1. Field of the Invention

The present invention relates to an outlet device for coin payout hoppers used in vending machines, game machines, coin exchangers or the like, in particular to an outlet chute adapted for guiding coins, to a vertically extending escalator out of the coin payout hopper.

2. Related Art Statement

Hitherto, there is a coin payout hopper as described in U.S. Pat. No. 4,589,433 comprising a hopper for storing coins, a rotary disc rotatably mounted on a supporting plate inclined at an angle to the horizontal within said hopper, a plurality of delivery pins spaced in the peripheral direction of the rotary disc and a delivery knife for guiding coins at an upper delivery portion to a discharge chute.

Some coin payout hoppers of the type mentioned above are provided with an outlet device which comprises an outlet chute for receiving coins discharged from the coin payout hopper. and an escalator which is connected at the lower end thereof to an upper outlet of the outlet chute and upwardly extends from the outlet chute for transferring coins to a coin tray which is elevated with respect to the hopper as described in U.S. Pat. No. 4,943,258.

In the conventional outlet chute of such an outlet device, as shown in FIGS. 6 and 7, the outlet chute 1 is composed of outside and inside front plates 2 and 3, a coin supporting back plate 4 inclined at an angle to the horizontal and outside and inside edge plates 5 and 6 interposed between the front and back plates to define a curved coin guiding passage 7 extending from a lower inlet 8 receiving coins "C" from a payout hopper to an upper outlet 10 connected to the lower end of the escalator 11. The curved coin guiding passage 7 has a depth between the front and back plates greater than the thickness of the coins, but less than twice the thickness of the coins and a width between the edge plates also greater than the diameter of the coins. The width of the curved coin guiding passage is defined by opposed outer and inner coin guiding edge faces 12 and 13 of the outside and inside edge plates 5 and 6 positioned at the outer and inner sides in relation to a center of curvature of the curved guiding passage 7, respectively. The outside and inside front plates 2 and 3 are rigidly secured to the back plate 4 together with the edge plates 5 and 6 by means of screws 15 and 16, respectively. The outside and inside front plates 2 and 3 have extensions **2*a* and 3*a* beyond the coin guiding edge faces 12 and 13 of the edge plates 5 and 6, respectively, to engage with the outer peripheral portion of the coins to retain the coins in the curved guiding passage and to prevent the coins from dropping out of the passage. Thus, the outlet chute 1 receives coins C pushed into the guiding passage 7 through the lower inlet 8 in the horizontal direction as shown by an arrow "A" and guides coins in single edge-to-edge file in the curved guiding passage 7 defined by the outside and inside front plates 2 and 3, the edge plates 5 and 6 and the back plate 4 towards the upper outlet 10** in the vertical direction as shown by an arrow "B" by a mutual thrust of coins pushed out of the coin payout hopper.

Such a conventional outlet device as mentioned above has drawbacks such that a deformed coin can be jammed in the guiding passage by outwardly or inwardly pushing against the edge of an adjacent coin. In such a case, the adjacent coin slips behind or in front of the deformed coin and against the front plates and blocks the passage of coins in the guiding passage.

SUMMARY OF THE INVENTION

An object of the invention is to eliminate the drawbacks mentioned above and to provide an outlet device preventing coins from jamming in the curved coin guiding passage by removing the deformed coins from the guiding passage.

According to the present invention, as shown in FIG. 2, an outlet device for a coin payout hopper comprises an outlet chute 1 having a curved coin guiding passage 7 for upwardly guiding coins pushed in a lower inlet 8 in the horizontal direction towards an upper outlet 10 in the vertical direction. The outlet chute 1 is composed of a back plate 4, a pair of outside and inside edge plates 5 and 6 secured to the opposite edge portions of the back plate so as to space the opposed coin guiding edge faces or tracks 12 and 13 of the edge plates from each other by a distance substantially corresponding to a diameter of a coin to be handled, and an elastically deformable inside front plate 20 of elastomer material such as rubber, covering only the inside edge plate 6 positioned at the inner side in relation to the center of curvature of the curved coin guiding passage 7. The front plate 20 has an extension **20*a* protruding beyond the inner coin guiding edge face 13 of the inside edge plate 6**.

With the construction mentioned above of the present invention, coins "C" pushed in the lower inlet 8 of the outlet chute in the horizontal direction from the coin payout hopper are pushed in single edge-to-edge file in the curved coin guiding passage 7 towards the upper outlet 10 in the vertical direction by mutual thrust of coins. Thus, the coins are urged against the outer coin guiding edge face 12 of the outside edge plate 5 positioned at the outer side in relation to the center of curvature of the curved coin guiding passage 7 as shown in FIG. 3 and therefore the coins can be fed towards the upper outlet 10 along the outer coin guiding edge face 12 in the curved guiding passage 7 defined only by the back plate 4, a pair of outside and inside edge plates 5 and 6 and the inside front plate 20 having the extension **20*a* without dropping out of the curved guiding passage 7** in spite of providing no outside front plate engaging the outside edge portions of the coins.

If a deformed coin "D" is pushed into the curved coin guiding passage and the front end of the deformed coin slips over the rear end of the preceding coin, the deformed coin pushes up the elastically deformable rubber plate 20 as shown in FIG. 4. The deformed coin therefore is pushed up on the preceding coin by a trailing coin as shown in FIG. 5 and then dropped over the outside edge plate 5 by the resiliently deformed inside front plate 20.

As mentioned above, according to the present invention, because the outside edge plate in the curved guiding passage is not provided with an outside front plate for preventing coins from dropping out of the guiding passage and the inside edge plate is provided with the resiliently deformable inside front plate having the extension preventing coins from dropping out, undeformed coins can be guided to the upper outlet and thence the escalator without dropping out of the guiding passage, but deformed coins are effectively removed from the guiding passage. Consequently, the problems of jamming with deformed coins in the curved guiding passage of the outlet chute as well as the outlet escalator downstream of the outlet chute are substantially optimally removed.

DESCRIPTION OF THE PREFERRED EMBODIMENT

Figure 1:
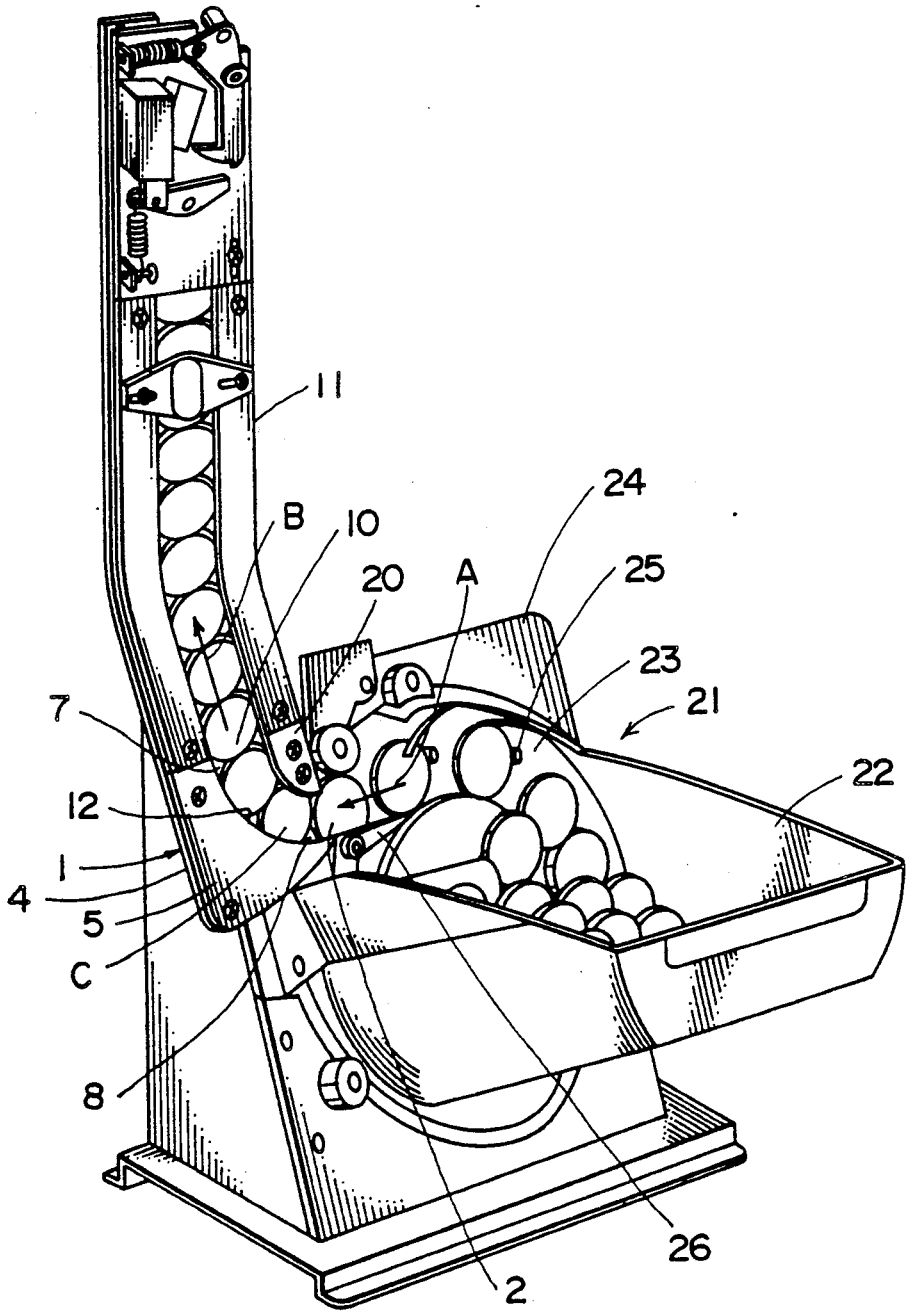
FIG. 1 is a schematic perspective view illustrating a coin payout hopper provided with the outlet chute according to the invention.

The invention will be described in more detail in the following with reference to the accompanying drawings.

Referring to FIGS. 1-5 illustrating a preferred embodiment of an outlet device according to the present invention, a coin payout hopper 21 includes a hopper 22 for storing a plurality of coins in bulk, and a rotary disc 23 which is rotatably supported on a supporting plate 24 inclined at an angle to the horizontal. The rotary disc 23 is provided with a plurality of coin feeding pins 25 spaced equidistantly around the peripheral portion thereof.

The outlet device includes an outlet chute 1 for receiving coins pushed in a lower inlet 8 in the horizontal direction as shown by an arrow A, from the coin payout hopper 21 along a delivery knife 26 which guides coins along an upper delivery portion of the coin payout hopper to the outlet chute, and an outlet escalator 11 which is connected at the lower end thereof to an upper outlet 10 of the outlet chute 1 for receiving coins pushed up substantially in the vertical direction as shown by an arrow B.

Figure 2:
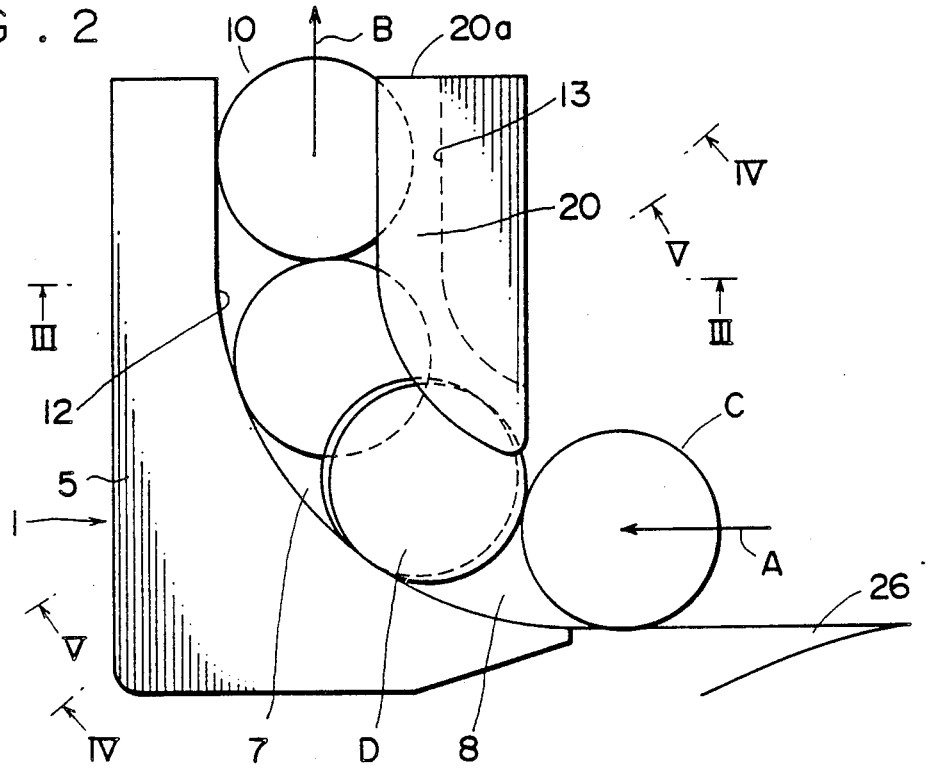
FIG. 2 is an enlarged elevational view of the outlet chute of the coin payout hopper according to the present invention shown in FIG. 1.
Figure 3:
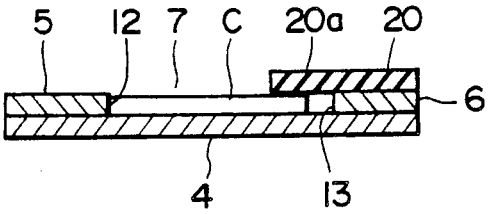
FIGS. 3-5 are sectional views taken on the lines III—III, IV—IV and V—V in FIG. 2, respectively, illustrating the operation of a rubber front plate.
Figure 4:
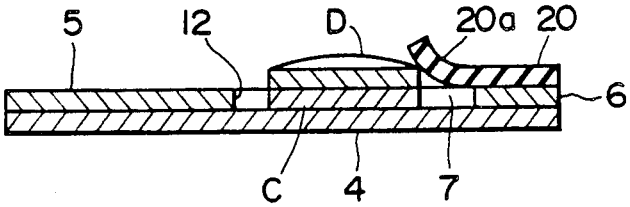
Figure 5:
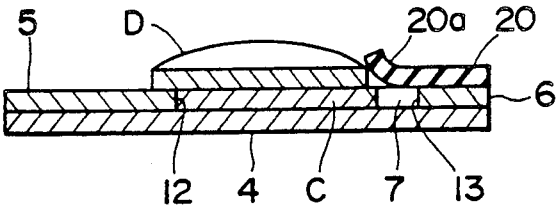
Figure 6:
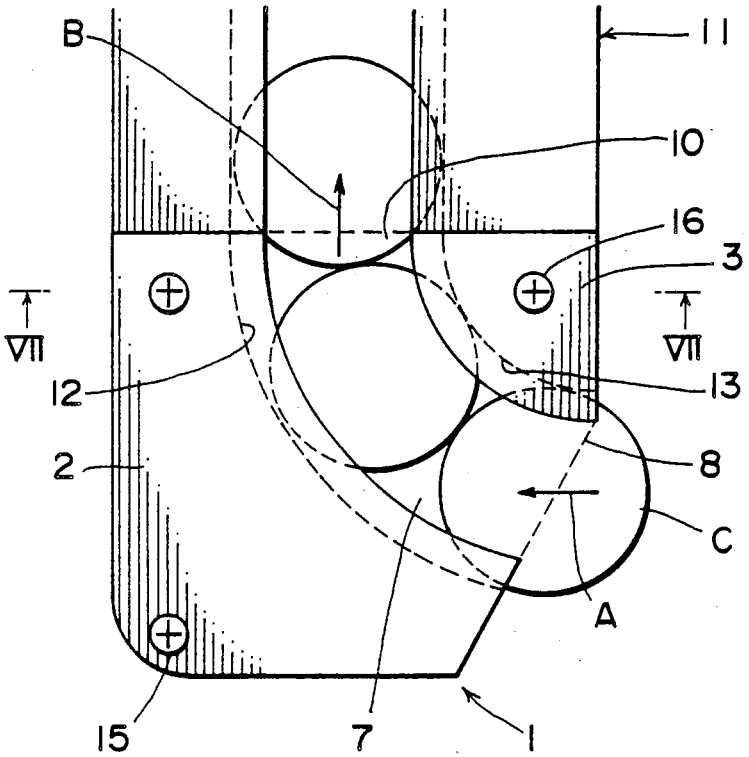
FIG. 6 PRIOR ART
FIG. 6 is an enlarged elevational view of an outlet chute of the prior art.
Figure 7:
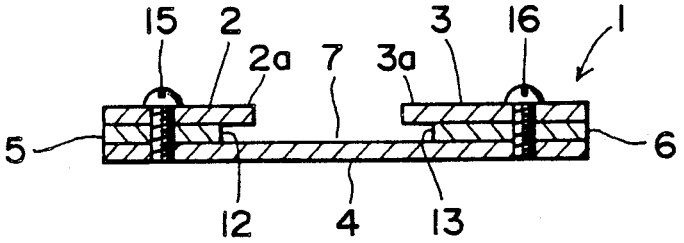
FIG. 7 PRIOR ART
FIG. 7 is a sectional view taken on the line VII—VII in FIG. 6.

Referring to FIG. 2, the outlet chute 1 is provided with a curved coin guiding passage 7 which is defined by a coin supporting back plate 4 inclined at an angle to the horizontal, a pair of outside and inside edge plates 5 and 6 secured to the opposite respective edge portions of the back plate 4 by means of screws so as to space the opposed outer and inner coin guiding edge faces or tracks 12 and 13 of the edge plates 5 and 6 from each other by a distance corresponding to the diameter of the coin to be handled, and an elastically deformable inside front plate 20 of elastomer material such as urethane rubber, which is secured to the back plate 4 together with the inside edge plate 6 positioned at the inner side in relation to the center of curvature of the curved coin guiding passage 7. The elastically deformable inside front plate 20 has an extension **20*a* protruding beyond the inner guiding edge face 13 of the inside edge plate 6 for preventing coins from dropping out of the curved coin guide passage 7**.

The elastically deformable inside front plate 20 is preferably made of urethane rubber having a hardness of 60°-90° and a thickness in a range of 0.5-2 mm.

What is claimed is:

1. An outlet device for a coin payout hopper so constructed as to remove deformed coins to prevent jamming, the device comprising an outlet chute having a curved coin guiding passage for upwardly guiding coins pushed in a lower inlet in the horizontal direction towards an upper outlet in the vertical direction, the outlet chute being composed of a back plate, a pair of outside and inside edge plates secured to the opposite edge portions of the back plate so as to space the opposed coin guiding edge faces of the edge plates from each other by a distance substantially corresponding to a diameter of a coin to be handled, and an elastically deformable inside front plate of elastomer material covering only the inside edge plate positioned at the inner side in relation to a center of curvature of the curved coin guiding passage, the elastically deformable inside front plate having an extension so constructed and arranged as to protrude beyond the inner coin guiding edge face of the inside edge plate only to an extent less than the center of the coin guiding passage so that deformed coins can pass out of the chute to prevent jamming.

2. The outlet device claimed in claim 1, wherein the elastomer material is urethane rubber of a hardness in a range of 60°-90°.

3. The outlet device claimed in claim 1, wherein the elastically deformable inside front plate has a thickness in a range of 0.5-2 mm.

4. The outlet device claimed in claim 1, wherein the back plate is inclined at an angle to the horizontal.

5. The outlet device claimed in claim 1, wherein the curved coin guiding passage is opened upwards.

* * * * *